US006070297A

United States Patent [19]

Borer

[11] Patent Number: 6,070,297

[45] Date of Patent: Jun. 6, 2000

[54] CONCEALED HINGE FOR REMOVABLE COVER ENCLOSURES

[75] Inventor: Brent R. Borer, Columbia, S.C.

[73] Assignee: Square D Company, Palatine, Ill.

[21] Appl. No.: 08/999,288

[22] Filed: Dec. 29, 1997

[51] Int. Cl.[7] ..... E05D 7/10

[52] U.S. Cl. ..... 16/266; 16/389; 49/398

[58] Field of Search ..... 16/265, 266, 389; 49/398

[56] References Cited

U.S. PATENT DOCUMENTS

| | | | |
|---|---|---|---|
| 2,677,147 | 5/1954 | Phillips | 16/266 |
| 3,619,853 | 11/1971 | Merrill | 16/389 |
| 4,881,298 | 11/1989 | Turnbull | 16/266 |
| 4,916,968 | 4/1990 | Kabaya | 16/266 |

FOREIGN PATENT DOCUMENTS

| | | | |
|---|---|---|---|
| 1234187 | 6/1971 | United Kingdom | 16/389 |
| 2245017 | 12/1991 | United Kingdom | 16/380 |

*Primary Examiner*—Chuck Y. Mah
*Assistant Examiner*—Donald M. Gurley
*Attorney, Agent, or Firm*—David R. Stacey; Larry T. Shrout; Larry I. Golden

[57] ABSTRACT

The present invention provides a concealed hinge for a removable cover and includes an integrally formed locking mechanism which prevents vertical movement of the cover when it is in the closed position. The hinge is made from two parts, one being welded to the cover and one being welded to the enclosure. One of the parts includes an integrally formed locking arm which continuously engages the other hinge part except when the cover is completely open, thus preventing any vertical movement of the cover which might defeat a cover safety interlock. The hinge is completely concealed by a flange of the cover to which it attached.

20 Claims, 4 Drawing Sheets

CONCEALED HINGE FOR REMOVABLE COVER ENCLOSURES

FIELD OF THE INVENTION

The present invention relates to hinged cover enclosures and specifically to concealed hinges for removable cover enclosures.

BACKGROUND OF THE INVENTION

Enclosures for electrical equipment are generally provided with hinged covers. These enclosures are usually metal and have inexpensively manufactured pined hinges welded to both the cover and the enclosure such that the cover is permanently attached to the enclosure. The permanently attached cover does not permit vertical movement of the cover which could defeat a cover safety interlock, which is intended to prevent the cover from being opened when electrical equipment inside the enclosure is operating. In some applications, a completely removable cover is required. In these applications, the hinge must permit the cover to be removed while still preventing movement when the cover is closed. This has usually been accomplished by some additional locking mechanism which secures the cover to the enclosure and prevents movement when the cover is closed. In order to remove the cover from the enclosure the locking mechanism must be manipulated. Additionally, it is possible that the locking mechanism can be tampered with such that the cover interlock can be defeated, thus allowing access to the enclosure. It is also becoming more important for enclosures to be aesthetically pleasing, which may require that the hinges be concealed to produce clean lines. A hinge meeting the stated requirements can require a number of parts and be expensive to manufacture. It would be desirable to have an inexpensive, easily manufactured, two piece, concealed hinge for a removable cover.

SUMMARY OF THE INVENTION

The present invention provides a concealed hinge for a removable cover and includes an integrally formed locking mechanism which prevents movement of the cover when it is closed. The hinge is made from two parts, one being welded to the cover and one being welded to the enclosure. One of the parts includes an integrally formed locking arm which continuously engages the other hinge part except when the cover is completely open, thus preventing any movement of the cover which might defeat a cover interlock.

Figure 1:
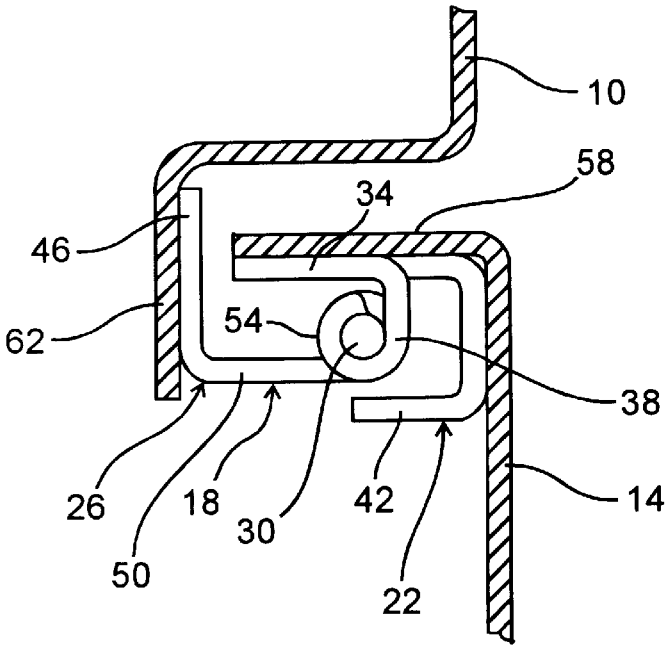
FIG. 1 is a top partial section view of an enclosure with cover and a hinge in accordance with the present invent on, the cover being fully open.

Before one embodiment of the invention is explained in detail, it is to be understood that the invention is not limited in its application to the details of construction and description or as illustrated in the drawings. The invention is capable of other embodiments and of being practiced or being carried out in various other ways. Also, it is to be understood that the phraseology and terminology used herein is for the purpose of description and should not be regarded as limiting.

DESCRIPTION OF THE PREFERRED EMBODIMENT

FIG. 1 is a partial section view of an enclosure 10 and a cover 14 looking down on a hinge of the present invention, generally indicate by reference numeral 18. The hinge 18 is comprised of a first hinge part 22, a second hinge part 26 and a hinge pin 30. The first hinge part 22 includes a generally rectangular base 34 having an integrally formed curl 38 at one end and a J-shaped cross-section at the other end, the short leg of which forms a locking arm 42. The curl 38 extends longitudinally along an edge of the base 34 such that its longitudinal axis passes generally half way between the base 34 and the locking arm 42 of the J-shaped cross-section at the other end of the base 34. The distance between the base 34 and the locking arm 42 at the J-shaped cross-section is dimensioned to be slightly greater than the outside diameter of the curl 38. The curl 38 is spaced apart from the locking arm 42 by a distance slightly greater than the width of the second hinge part 26. The second hinge part 26 is generally L-shaped in cross-section with one leg forming a base 46 and the other leg 50 ending in a curl 54. The hinge pin 30 is preferably fixed in one of the curls 38 or 54 and slidably received in the other of the curls 38 or 54 such that the cover 14 is pivotably attached to the enclosure 10 by the hinge 18. In FIG. 1 the cover 14 is in the fully open position, which is the only position in which the cover 14 can be removed from and installed on the enclosure 10. In this position the locking arm 42 of the first hinge part 22 is allowed to slidably pass by the leg 50 and curl 54 of the second hinge part 26.

Figure 2:
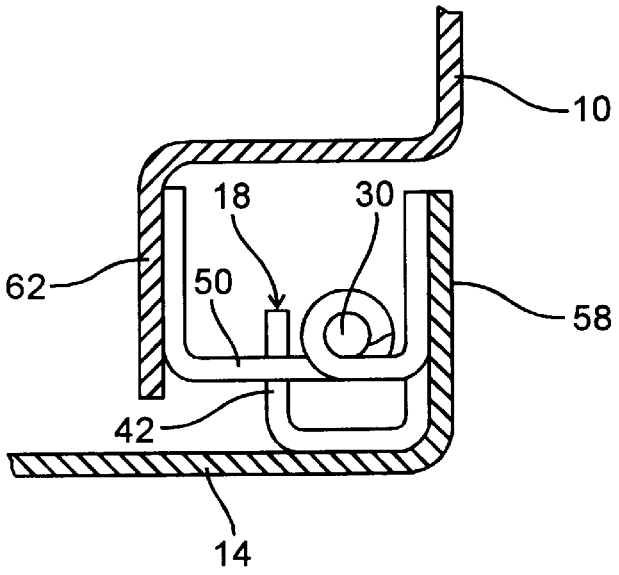
FIG. 2 is a top partial section view of an enclosure with cover and a hinge in accordance with the present invention, the cover being closed.

Referring now to FIG. 2, which is the same partial section view as in FIG. 1, however, the cover 14 is shown in the closed position. In the closed position the leg 50 and curl 54 of the second hinge part 26 are captivated between the locking arm 42 and curl 38 of the first hinge part 22. This captivation prevents any movement of the cover 14 in the closed position that would allow the defeating of a cover interlock.

Figure 3:
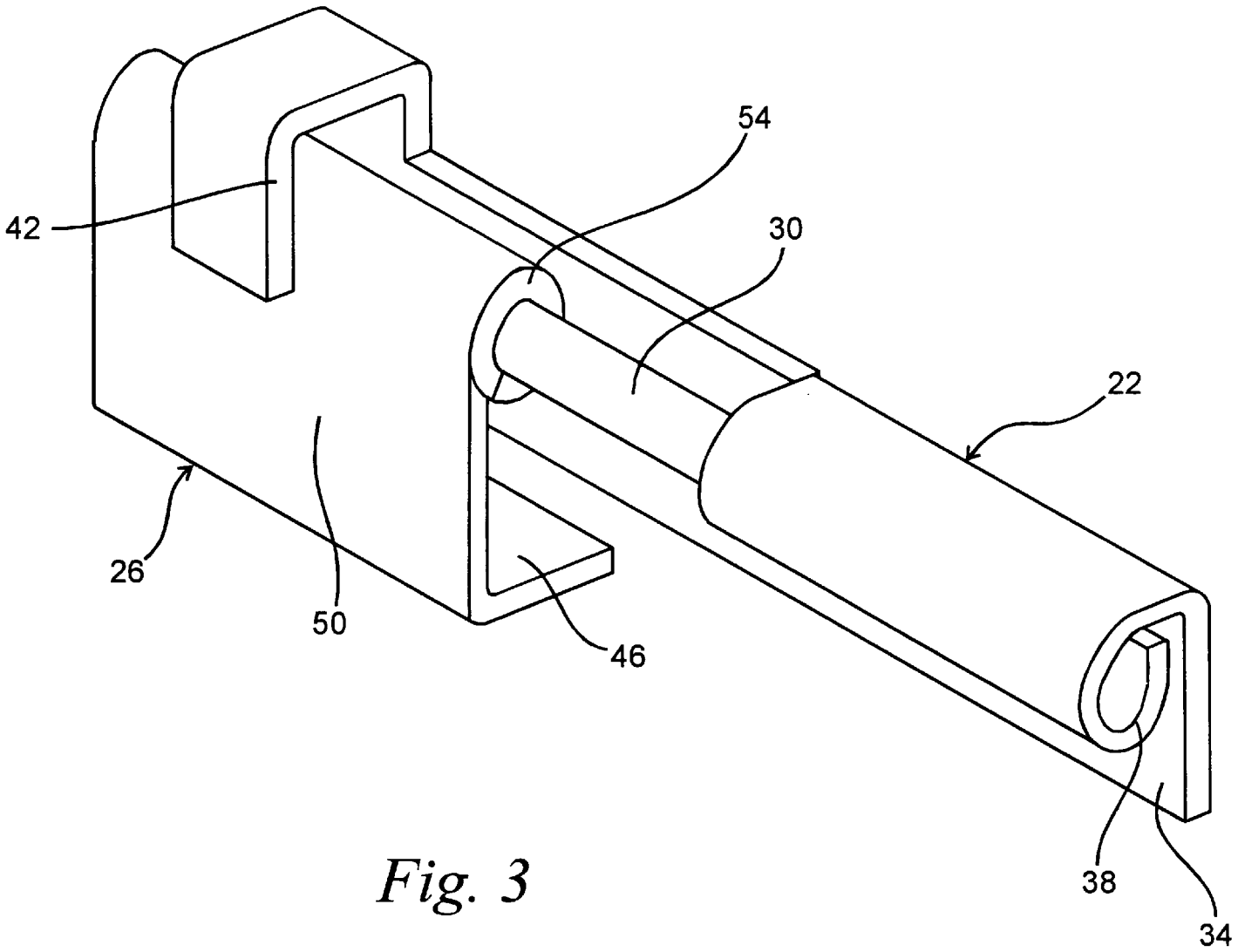
FIG. 3 is an isometric view of the two hinge elements partially assembled.

FIG. 3 illustrates the relative positions of the first and second hinge parts, 22 and 26 respectively, during removal or installation of the cover 14. As the hinge pin 30 is slidably received on one of the curls 38 or 54, the leg 50 and curl 54 of the second hinge part 26 slidably pass by the locking arm 42 of the first hinge part 22. The cover 14 must remain in the full open position until it is completely removed from, or installed on the enclosure 10. Any attempt to rotate the cover 14 during installation or removal would be blocked by interference between the locking arm 42 of the first hinge part 22 with the leg 50 of the second hinge part 26.

Figure 4:
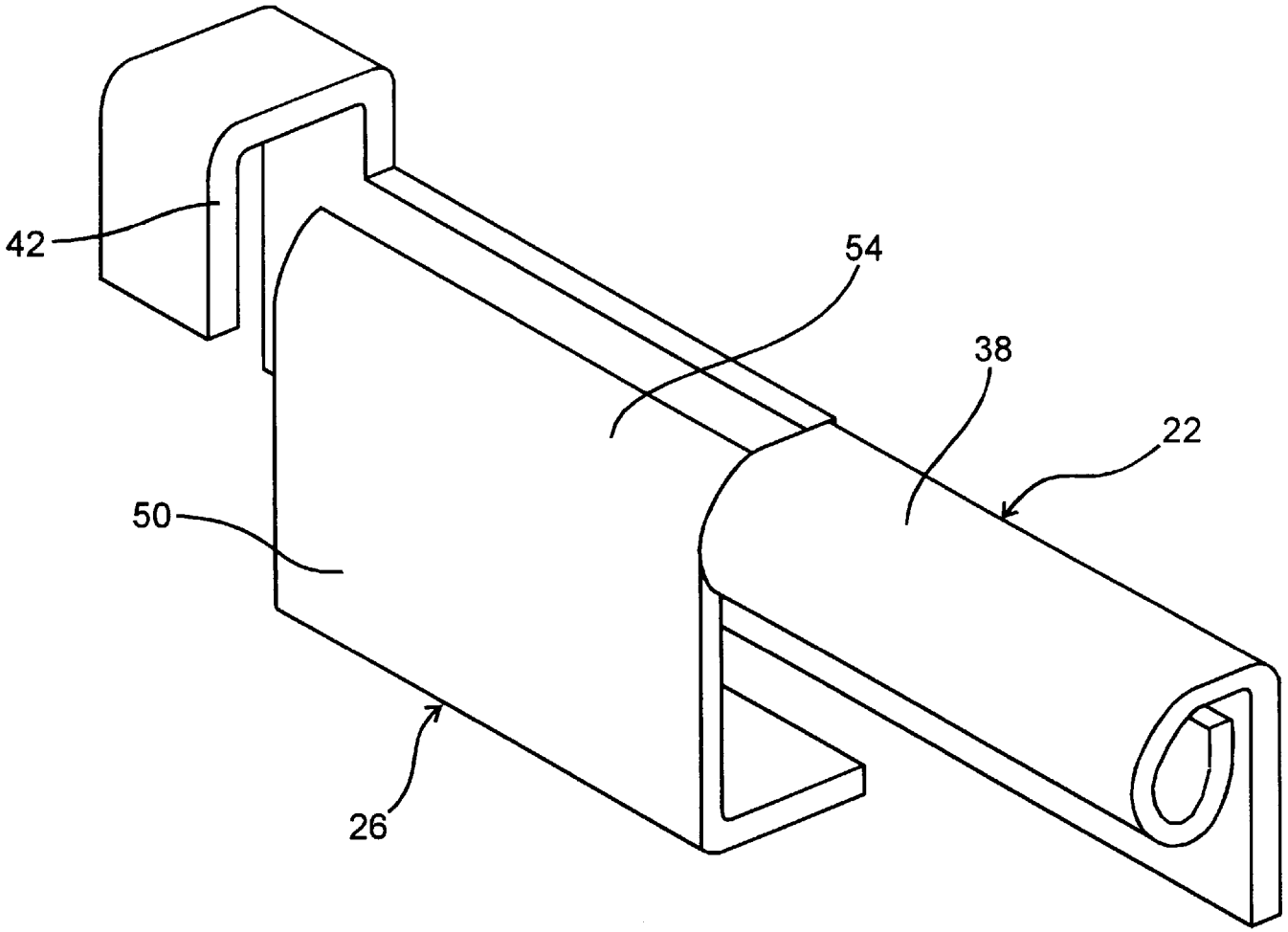
FIG. 4 is an isometric view of the two hinge elements fully assembled in the cover open position.

FIG. 4 illustrates the relative positions of the first and second hinge parts, 22 and 26 respectively, when the cover 14 is installed and in the fully open position. In this position the first and second hinge parts, 22 and 26 respectively can rotate freely about the hinge pin 30 allowing the cover 14 to be opened or closed.

Figure 5:
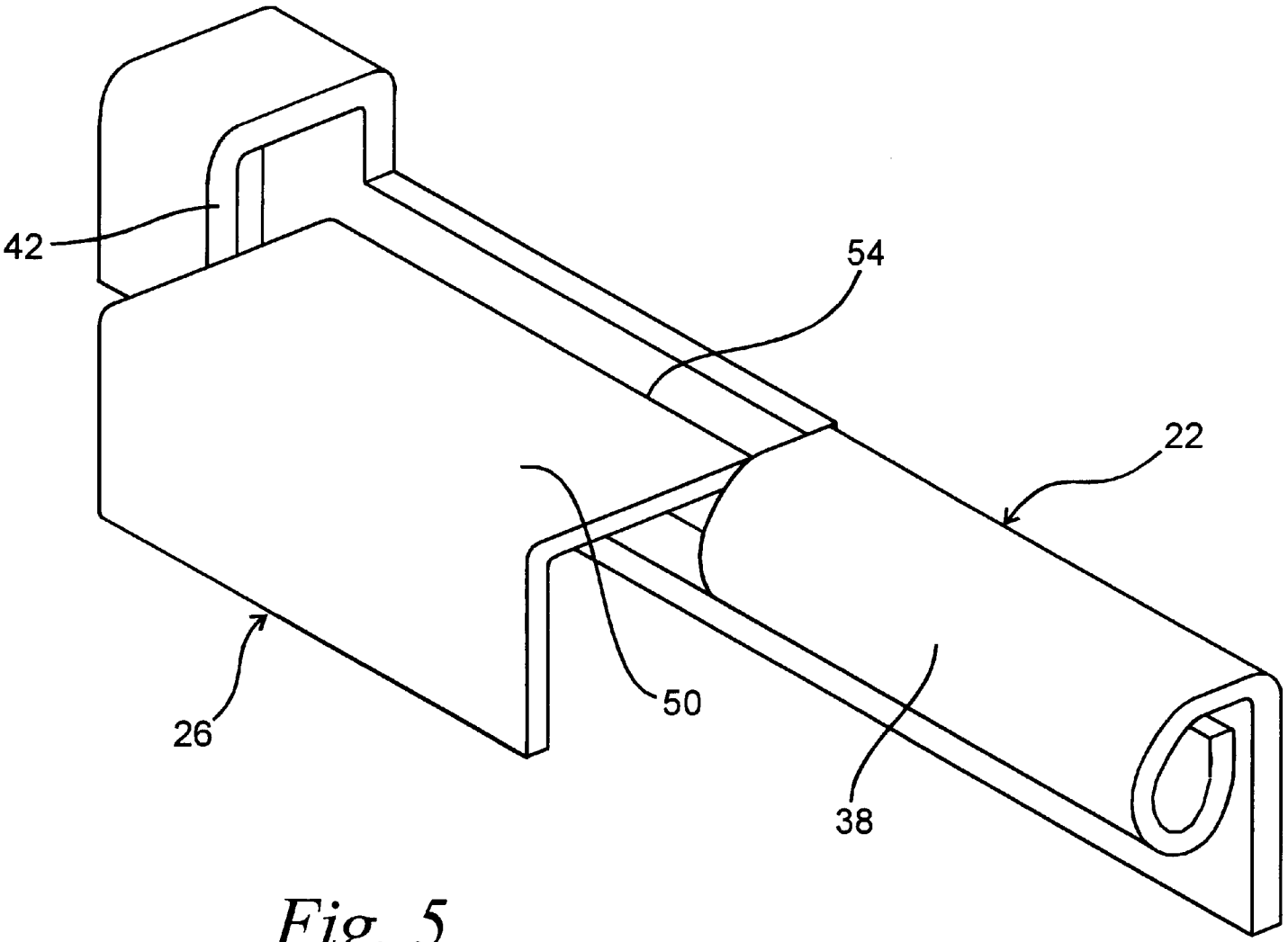
FIG. 5 is an isometric view of the two hinge elements fully assembled in the cover closed position.

FIG. 5 illustrates the relative positions of the first and second hinge parts, 22 and 26 respectively, when the cover 14 is installed and in the fully closed position. In the cover closed position the leg 50 and curl 54 of the second hinge part 26 are captivated between the curl 38 and locking arm 42 of the first hinge part 22. The space between the curl 38 and locking arm 42 of the first hinge part 22 is dimensioned to snugly but rotatably receive the leg 50 and curl 54 of the second hinge piece 26 thus preventing any movement of the cover 14 along the axis of the hinge pin 30. This restriction of linear cover 14 movement prevents the defeating of a cover interlock.

In the embodiment as shown in FIGS. 1 and 2, the base 26 of the first hinge part 22 is attached to a flange 58 of the cover 14 and the base 46 of the second hinge part 26 is attached to a flange 62 of the enclosure 10. The preferred method of attaching is by welding, however, other suitable means such as rivets or screws can be used. It is within the scope of the invention to reverse the placement of the first and second hinge parts, 22 and 26 respectively. It is also shown in FIG. 2 that the hinge 18 is completely concealed by the cover flange 58, thus giving an aesthetically pleasing appearance to the enclosure 10.

I claim:

1. A hinge for an enclosure having a selectively removable cover, said hinge comprising:

a first hinge part having a generally rectangular base for attaching to one of the enclosure or the cover, said base defining a J-shaped cross-section at one end, the short leg of which forms a locking arm, said base further defining an integrally formed curl along an edge at the other end, the extended longitudinal axis of said curl passing approximately half way between said base and said locking arm;

a second hinge part being generally L-shaped in cross-section such that one leg is attachable to the other of the enclosure or the cover and the other leg defines an integrally formed curl along it's end; and a hinge pin being fixed within said curl of one of said first or second hinge parts and being slidably received within said curl of the other of said first or second hinge parts only when the cover is in a fully open position.

2. The hinge of claim 1 wherein said curl of said first hinge part is spaced apart from said locking arm by a distance slightly greater than the width of said second hinge part.

3. The hinge of claim 2 wherein said curl of said second hinge part is captivated between said curl and said locking arm of said first hinge part when the cover is not in a fully open position.

4. The hinge of claim 2 wherein the cover is removable from the enclosure only when in the full open position.

5. The hinge of claim 2 the cover can be placed on the enclosure only when in the full open position.

6. A hinge for an enclosure having a selectively removable cover, said hinge comprising:

a first hinge part having a generally rectangular base for attaching to one of the enclosure or the cover, said base defining a J-shaped cross-section at one end, the short leg of which forms a locking arm, said base further defining an integrally formed curl along an edge at the other end, the extended longitudinal axis of said curl passing approximately half way between said base and said locking arm, said curl and said locking arm being spaced apart one from the other;

a second hinge part being generally L-shaped in cross-section such that one leg is attachable to the other of the enclosure or the cover and the other leg defines an integrally formed curl along it's end; and a hinge pin being fixed within said curl of one of said first or second hinge parts and being slidably received within said curl of the other of said first or second hinge parts only when the cover is in a fully open position.

7. The hinge of claim 6 wherein the space between said curl and said locking arm of said first hinge part is dimensioned to be slightly greater than the width of said second hinge part.

8. The hinge of claim 7 wherein said curl of said second hinge part is captivated between said curl and said locking arm of said first hinge part when the cover is not in a fully open position.

9. The hinge of claim 7 wherein the cover is removable from the enclosure only when in the full open position.

10. The hinge of claim 7 the cover can be placed on the enclosure only when in the full open position.

11. A concealed hinge for an enclosure having a selectively removable cover, said hinge comprising:

a first hinge part having a generally rectangular base for attaching to one of the enclosure or the cover, said base defining a J-shaped cross-section at one end, the short leg of which forms a locking arm, said base further defining an integrally formed curl along an edge at the other end, the extended longitudinal axis of said curl passing approximately half way between said base and said locking arm;

a second hinge part being generally L-shaped in cross-section such that one leg is attachable to the other of the enclosure or the cover and the other leg defines an integrally formed curl along it's end; and a hinge pin being fixed within said curl of one of said first or second hinge parts and being slidably received within said curl of the other of said first or second hinge parts only when the cover is in a fully open position;

said first and second hinge parts being concealed behind a flange of the cover.

12. The hinge of claim 11 wherein said curl of said first hinge part is spaced apart from said locking arm by a distance slightly greater than the width of said second hinge part.

13. The hinge of claim 12 wherein said curl of said second hinge part is captivated between said curl and said locking arm of said first hinge part when the cover is not in a fully open position.

14. The hinge of claim 12 wherein the cover is removable from the enclosure only when in the full open position.

15. The hinge of claim 12 the cover can be placed on the enclosure only when in the full open position.

16. A hinge for an enclosure having a selectively removable cover, said hinge comprising:

a hinge pin providing pivotal movement of the cover with respect to the enclosure;

a first hinge part having a generally rectangular base for attaching to one of the enclosure or the cover, said first hinge part defining a locking arm at one end and a curl for receiving said hinge pin along an edge at the other end;

a second hinge part being generally L-shaped in cross-section such that one leg is attachable to the other of the enclosure or the cover and the other leg defines a curl along it's end for receiving said hinge pin, said second hinge part being captivated by said locking arm to prevent vertical movement of the cover.

17. The hinge of claim 16 wherein said first hinge part defines a J-shaped cross-section at an end opposite said curl, said locking arm being a short leg of said J-shaped cross-section and said base being the long leg of said J-shaped cross-section.

18. The hinge of claim 17 wherein a longitudinal axis of said curl passes approximately half way between said base and said locking arm of said first hinge part.

19. The hinge of claim 16 wherein said curl of said first hinge part is spaced apart from said locking arm by a distance slightly greater than the width of said second hinge part such that when both said first and second hinge parts are fully installed on said hinge pin a rotational movement of one of said first or second hinge parts with respect to the other of said first or second hinge parts is possible.

20. The hinge of claim 16 wherein the cover is removable from the enclosure only when in the fully open position.

* * * * *